US006981491B2

(12) United States Patent
Schmitt et al.

(10) Patent No.: US 6,981,491 B2
(45) Date of Patent: Jan. 3, 2006

(54) COUPLING VALVE STRUCTURE FOR FUEL SUPPLY MODULE

(75) Inventors: Jochen Schmitt, Langen (DE); Holger Dilchert, Frankfurt (DE); Michael Teichert, Schwalbach/Taunus (DE); Andreas Bernert, Bad Homburg (DE)

(73) Assignee: Siemens VDO Automotive Corporation, Auburn Hills, MI (US)

( * ) Notice: Subject to any disclaimer, the term of this patent is extended or adjusted under 35 U.S.C. 154(b) by 0 days.

(21) Appl. No.: 11/014,650

(22) Filed: Dec. 16, 2004

(65) Prior Publication Data

US 2005/0166902 A1 Aug. 4, 2005

Related U.S. Application Data

(60) Provisional application No. 60/540,541, filed on Jan. 30, 2004.

(51) Int. Cl.
*F02M 37/04* (2006.01)

(52) U.S. Cl. ..... 123/514; 123/456

(58) Field of Classification Search ..... 123/179.17, 123/456, 514, 506, 500, 501, 446, 467
See application file for complete search history.

(56) References Cited

U.S. PATENT DOCUMENTS 4,984,554 A * 1/1991 Ariga et al. ..... 123/516
5,148,792 A * 9/1992 Tuckey ..... 123/497
5,715,798 A * 2/1998 Bacon et al. ..... 123/514
5,749,345 A * 5/1998 Treml ..... 123/456
6,007,711 A * 12/1999 Atwood ..... 210/136
6,253,735 B1 * 7/2001 Miyajima ..... 123/456
6,279,545 B1 * 8/2001 Frank et al. ..... 123/514
6,352,067 B1 * 3/2002 Genslak ..... 123/510
6,805,106 B2 * 10/2004 Kumagai et al. ..... 123/514

* cited by examiner

*Primary Examiner*—Carl S. Miller

(57) ABSTRACT

A coupling valve structure 26 is provided for a fuel supply module 20. The module has a fuel pump 20 disposed in a fuel reservoir 18, a feed line 21 in fluid communication with an outlet of the fuel pump for feeding fuel to a high pressure pump 16 and thus to an engine, and a return line 22 for returning excess fuel from the engine or high pressure fuel pump to the reservoir 18. The coupling valve structure 26 includes a check valve 28 constructed and arranged to communicate with the feed line to permit fuel to be delivered to the engine and to prevent the fuel from draining back to the fuel pump, and a pressure relief valve 30 integrally connected with the check valve via a conduit 23. The pressure relief valve 30 is constructed and arranged to communicate with the return line such that when pressure of the fuel at the check valve 28 is outside a certain pressure range, the pressure relief valve will open to permit fuel in the conduit to enter the return line to thereby maintain fuel exiting the check valve within the certain pressure range.

18 Claims, 4 Drawing Sheets

COUPLING VALVE STRUCTURE FOR FUEL SUPPLY MODULE

This Application is based on U.S. Provisional Application No. 60/540,541, filed on Jan. 30, 2004, and claims the benefit thereof for priority purposes.

FIELD OF THE INVENTION

This invention relates to fuel supply module for vehicles and, more particularly, to a coupling valve structure that incorporates a check valve and pressure relief valve.

BACKGROUND OF THE INVENTION

Conventional fuel supply modules include a fuel pump in a reservoir that is mounted in a fuel tank. A fuel supply line is provided to deliver fuel pumped by the fuel pump to an engine or a high-pressure fuel pump. Typically, a check valve is provided in a fuel supply line to prevent fuel from returning to the reservoir. In addition, a separate regulator or pressure relief valve is typically provided in another part of the fuel supply line to ensure that fuel is delivered to the engine at a predetermined pressure.

The use of a separate check valve and regulator increases the part count, assembly time, and cost of the conventional fuel delivery system.

Thus, there is a need to provide a coupling valve structure that combines the function of the check valve and pressure relief valve in one structure.

SUMMARY OF THE INVENTION

An object of the invention is to fulfill the need referred to above. In accordance with the principles of the present invention, this objective is achieved by providing a structure for a fuel supply module. The module has a fuel pump disposed in a fuel reservoir, a feed line in fluid communication with an outlet of the fuel pump for feeding fuel to an engine or high pressure fuel pump, and a return line for returning excess fuel from the engine to the reservoir. The structure includes a check valve constructed and arranged to communicate with the feed line to permit fuel to be delivered to the engine and to prevent the fuel from draining back to the fuel pump, and a pressure relief valve integrally connected with the check valve via a conduit. The pressure relief valve is constructed and arranged to communicate with the return line such that when pressure of the fuel at the check valve is outside a certain pressure range, the pressure relief valve will open to permit fuel in the conduit to enter the return line to thereby maintain fuel exiting the check valve within the certain pressure range.

In accordance with another aspect of the invention, a fuel supply system is provided for delivering fuel to an engine. The system includes a fuel reservoir constructed and arranged to be mounted in a fuel tank, a fuel pump disposed in the fuel reservoir, a high pressure pump constructed and arranged to deliver fuel to an engine, a feed line in fluid communication with an outlet of the fuel pump and an inlet of the high pressure pump for feeding fuel from the fuel pump to the high pressure pump, a return line for returning excess fuel from the engine or the high pressure fuel pump to the reservoir, and a coupling valve structure. The coupling valve structure includes a check valve constructed and arranged to communicate with the feed line to permit fuel to be delivered to the engine and to prevent the fuel from draining back to the fuel pump, and a pressure relief valve integrally connected with the check valve via a conduit. The pressure relief valve is constructed and arranged to communicate with the return line such that when pressure of the fuel at the check valve is outside a certain pressure range, the pressure relief valve will open to permit fuel in the conduit to enter the return line to thereby maintain fuel exiting the check valve within the certain pressure range.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE EXEMPLARY EMBODIMENT

Figure 1:
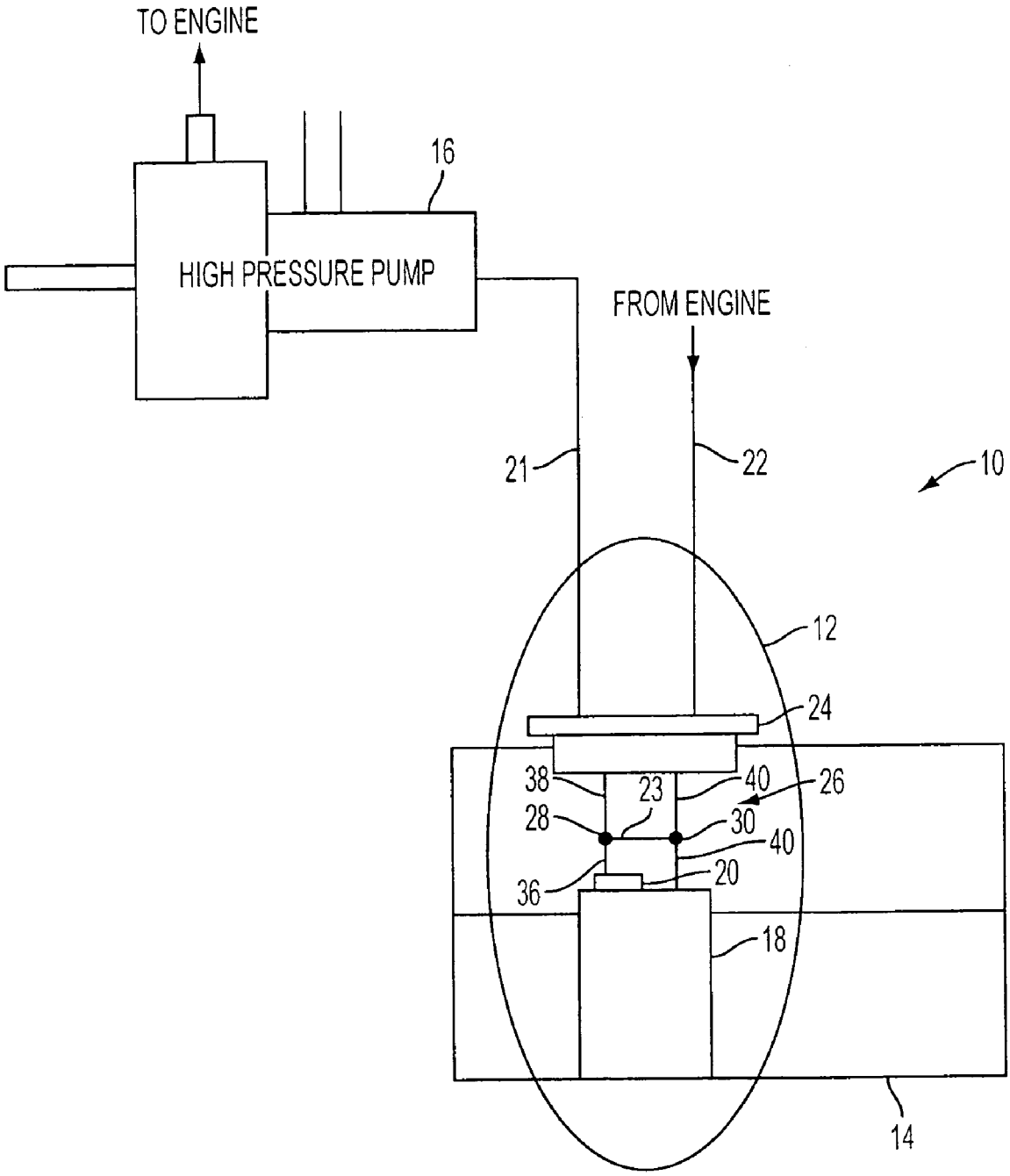
FIG. 1 is a schematic illustration of a fuel supply system incorporating a coupling valve structure provided in accordance with the principles of the present invention.

With reference to FIG. 1, a fuel supply system, generally indicated at 10, includes fuel supply module encircled at 12, contained inside a fuel tank 14, and high pressure pump 16, which is external to fuel tank 14. Operationally, fuel from tank 14 enters a reservoir 18 of module 12 and is pumped, via fuel pump 20, to the high pressure pump 16, via a feed line 21. The high-pressure pump delivers fuel into an engine (not shown). Fuel that is not used by engine or the high pressure fuel pump returns to the reservoir 18 via a return line 22. Module 12 thus includes the reservoir 18, the fuel pump 20, a flange 24 and, in accordance with the principles of the invention, coupling valve structure, generally indicated at 26.

Figure 2:
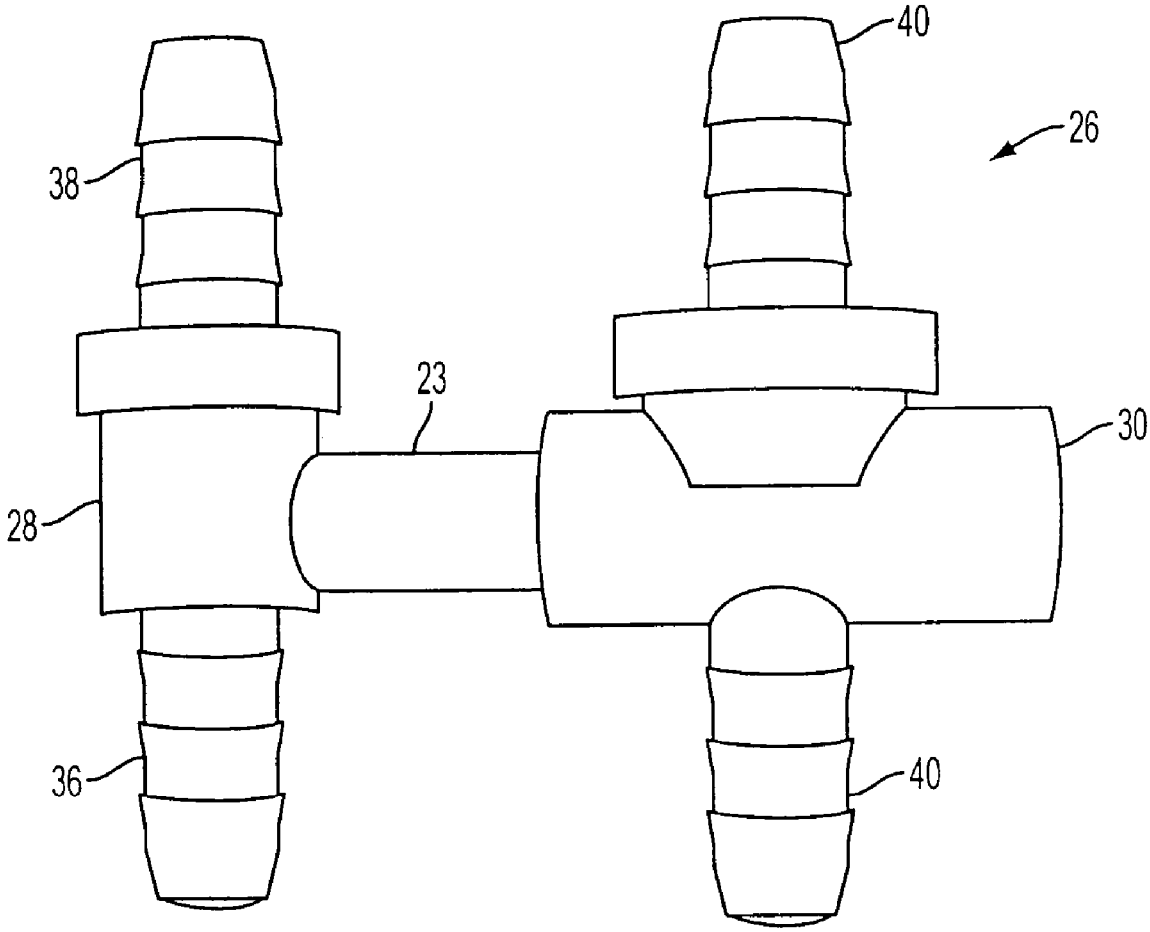
FIG. 2 is an enlarged front view of a coupling valve structure provided in accordance with the principles of the present invention.
Figure 3:
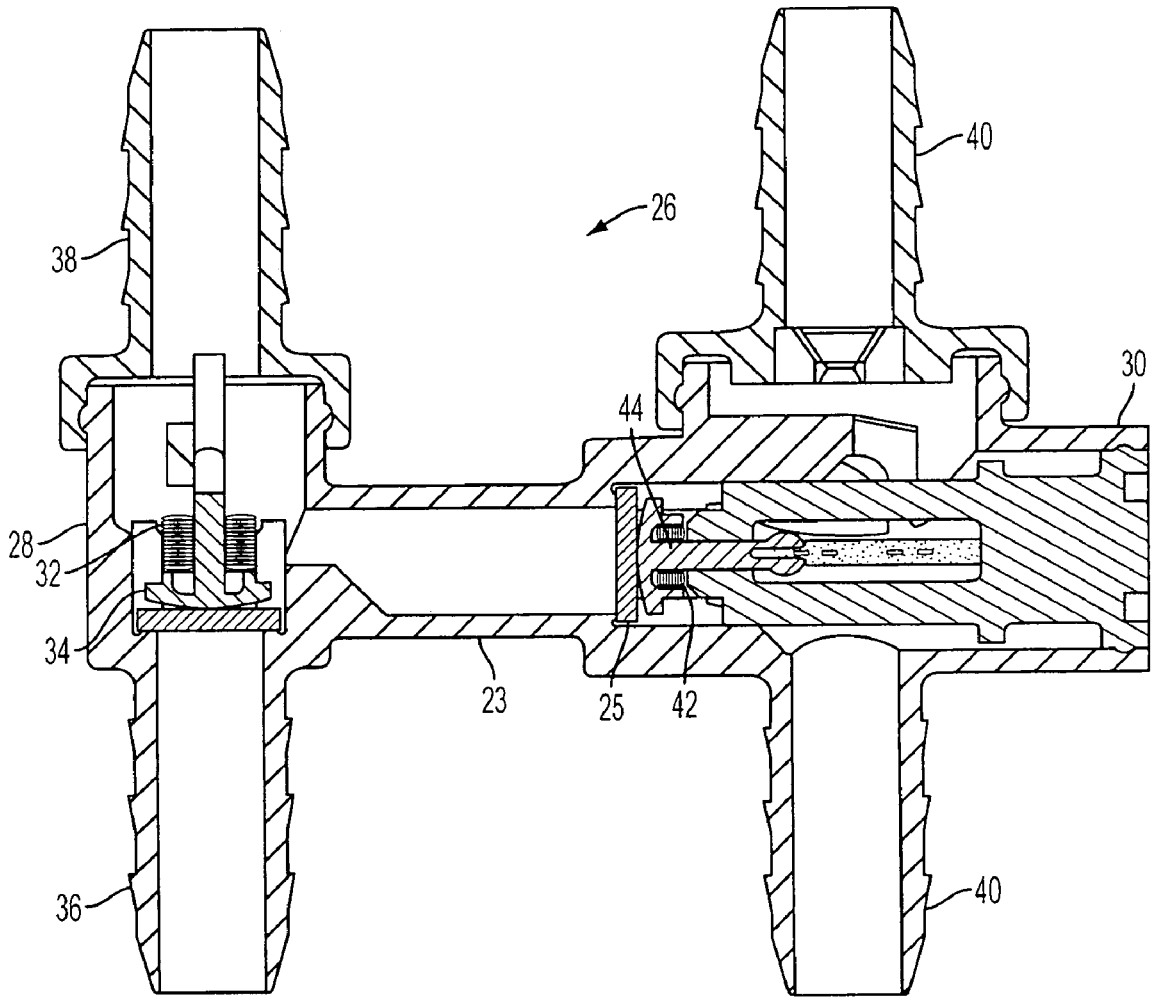
FIG. 3 is a sectional view of the coupling valve structure of FIG. 2.

With reference to FIG. 2, the coupling valve structure 26 is preferably a one-piece structure that is located between the flange 24 and reservoir 18. As best shown in FIG. 3, the coupling valve structure 26 includes a check valve 28 integrally connected with a pressure relief valve 30 via a conduit 23. Preferably, structure 26 is located between the fuel pump 20 and the flange 24 of supply module 20. Alternatively, the structure 26 can be integrated with the flange 24. The check valve 28 is preferably a conventional one-way valve permitting fuel to be pumped from the fuel pump 20 to line 21. The check valve 28 has a spring 32 to bias a valve element 34 to a closed position preventing fuel from returning to the fuel pump 20 via line 36 (FIG. 1). In the embodiment, line 36 includes a barbed fitting defining a conduit that is coupled with tubing that is connected to the fuel pump outlet.

In operation, pump 20 pumps fuel from reservoir 18 through the check valve 28, through the feed lines 38 and 21 to the high-pressure pump 16 (FIG. 1). In the embodiment, feed line 38 is a barbed fitting on the coupling valve structure 26 that receives tubing (not shown) that communicates ultimately with feed line 21. Thus the fitting 38 and tubing associated therewith can be considered to be part of feed line 21. High-pressure pump 16 is then used to direct fuel to an engine (not shown). Diesel engines typically require the use of the high-pressure pump 16 to feed the engine with fuel. However, the coupling valve structure 26 can be used with non-diesel engines, with or without a high-pressure pump 16, depending on the application. In any event, the purpose of the check valve 28 is to prevent feed line 21 from draining such that high pressure pump 16 will minimize sucking in air at the inlet thereof.

The pressure relief valve 30 is constructed and arranged to continuously permit fuel in the return line 22 to return to the reservoir 18 while normally closing an end 25 of the conduit 23 that communicates with the check valve 28. Thus, the pressure relief valve 30 is in fluid communication with the check valve 28 via the conduit 23 such that at high-pressure variations of flow delivery from the reservoir 18, the pressure relief valve 30 will open and permit fuel in conduit 23 pass through now open end 25 to return to the reservoir 18. This keeps the feed line 21 pressure exiting the check valve 28 within a certain pressure range to improve the performance and proficiency of the high pressure pump 16 and therefore the engine. The coupling valve structure 26 has barbed fittings 40 communicating with the pressure relief valve 30. These fittings 40 receive tubing (not shown) that that communicates with the return line 22. Thus, the fittings 40 and tubing associated therewith can be considered to be part of the return line 22. When the pressure relief valve 30 is open, fuel in the conduit 23 is now free to flow into the return line 22 and back to the reservoir 18. The pressure relief valve 30 is preferably of the conventional spring biased type, with a spring 44 selected to ensure the opening of a valve member 44 at a predetermined pressure in conduit 23.

As shown in FIGS. 2 and 3, the check valve 28 communicates with the outlet of fuel pump 20 and with the inlet of high pressure pump 16 and the valve member 34 is preferably oriented generally vertically. In the preferred embodiment, the valve member 44 of the pressure relief valve 30 is oriented generally transversely with respect to the valve member 34 of the check valve 28.

Figure 4:
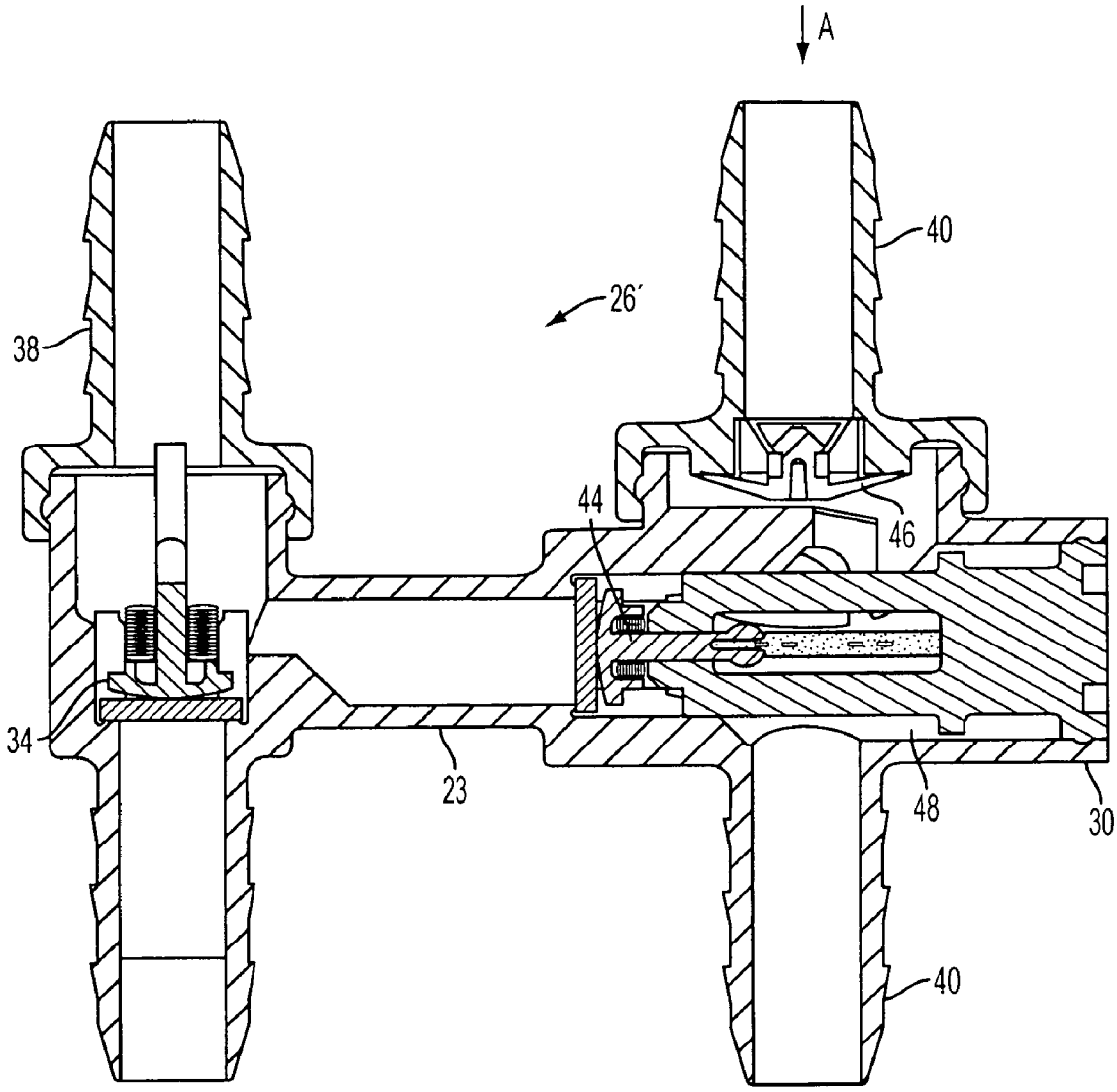
FIG. 4 is a schematic illustration of a fuel supply system incorporating a coupling valve structure provided in accordance with the principles of a second embodiment of the present invention.

With reference to FIG. 4, another embodiment of the coupling valve structure 26' is shown. The structure 26' is identical to the structure 26 of FIG. 1, except that in FIG. 4, a check valve 46, preferably in the form of an umbrella, is provided in fitting 40. The valve 46 permits fluid from the engine flowing in the direction of arrow A to enter chamber 48 and thus exit the lower portion of the fitting 40. The valve 46 prevents fluid to flow in a direction opposite the direction of arrow A. Thus, valve 46 prevents the return line 22 (FIG. 1) from draining when a vehicle rollover occurs.

Thus, coupling valve structure 26 performs a check valve function and a pressure relief function in one integral structure, which results in several advantages, including part and cost reduction.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A structure for a fuel supply module, the module having a fuel pump disposed in a fuel reservoir, a feed line in fluid communication with an outlet of the fuel pump for feeding fuel to an engine, and a return line for returning excess fuel from the engine to the reservoir, the structure comprising:

a generally H-shaped body having first and second legs joined by a conduit, the first leg being in fluid communication the feed line and the second leg being in fluid communication with the return line.

a check valve disposed within the first leg and constructed and arranged to permit fuel to be delivered to the engine and to prevent the fuel from draining back to the fuel pump, and a pressure relief valve disposed within the second leg and integrally connected with the check valve via the conduit, the pressure relief valve being constructed and arranged such that when pressure of the fuel at the check valve is outside a certain pressure range, the pressure relief valve will open to permit fuel in the conduit to enter the return line to thereby maintain fuel exiting the check valve within the certain pressure range.

2. The structure of claim 1, wherein the check valve includes a valve member and the pressure relief valve includes a valve member disposed generally transverse with respect to the valve member of the check valve.

3. The structure of claim 2, wherein each valve member is biased by a spring.

4. The structure of claim 1, further including fittings constructed and arranged to connect the check valve with the feed line and to connect the pressure relief valve with the return line.

5. The structure of claim 4, wherein the fittings are barbed fittings constructed and arranged to engage tubing.

6. The structure of claim 1, further comprising a second check valve disposed within the second leg and constructed and arranged to permit fluid to flow in one direction from the engine to the reservoir and to prevent fluid to flow in a direction opposite the one direction.

7. A structure for a fuel supply module, the module having a fuel pump disposed in a fuel reservoir, a feed line in fluid communication with an outlet of the fuel pump for feeding fuel to an engine, and a return line for returning excess fuel from the engine to the reservoir, the structure comprising:

a generally H-shaped body having first and second legs joined by a conduit, the first leg being in fluid communication the feed line and the second leg being in fluid communication with the return line, first means disposed within the first leg, for permitting fuel to be delivered to the engine and for preventing the fuel from draining back to the fuel pump, and second means, disposed within the second leg and integral with the first means and in fluid communication therewith via the conduit, for permitting fuel in the conduit to enter the return line when pressure of the fuel at first means is outside a certain pressure range, to thereby maintain fuel exiting the first means within the certain pressure range.

8. The structure of claim 7, wherein the first means is a check valve including a valve member and the second means is a pressure relief valve including a valve member disposed generally transverse with respect to the valve member of the check valve.

9. The structure of claim 8, wherein each valve member is biased by a spring.

10. The structure of claim 7, further including fittings constructed and arranged to connect the first means with the feed line and to connect the second means with the return line.

11. The structure of claim 10, wherein the fittings are barbed fittings constructed and arranged to engage tubing.

12. The structure of claim 7, further comprising a check valve disposed within the second leg and constructed and arranged to permit fluid to flow in one direction from the engine to the reservoir and to prevent fluid to flow in a direction opposite the one direction.

13. A fuel supply system for delivering fuel to an engine, the system comprising:

a fuel reservoir constructed and arranged to be mounted in a fuel tank, a fuel pump disposed in the fuel reservoir, a high-pressure pump constructed and arranged to deliver fuel to an engine, a feed line in fluid communication with an outlet of the fuel pump and an inlet of the high pressure pump for feeding fuel from the fuel pump to the high pressure pump, a return line for returning excess fuel from the engine or high-pressure pump to the reservoir, and a coupling valve structure comprising:

a generally H-shaped body having first and second legs joined by a conduit, the first leg being in fluid communication the feed line and the second leg being in fluid communication with the return line.

a check valve disposed within the first leg and constructed and arranged to permit fuel to be delivered to the engine and to prevent the fuel from draining back to the fuel pump, and a pressure relief valve disposed within the second leg and integrally connected with the check valve via the conduit, the pressure relief valve being constructed and arranged to communicate with the return line such that when pressure of the fuel at the check valve is outside a certain pressure range, the pressure relief valve will open to permit fuel in the conduit to enter the return line to thereby maintain fuel exiting the check valve within the certain pressure range.

14. The system of claim 12, wherein the check valve includes a valve member and the pressure relief valve includes a valve member disposed generally transverse with respect to the valve member of the check valve.

15. The system of claim 14, wherein each valve member is biased by a spring.

16. The system of claim 13, wherein the coupling valve structure further includes fittings connecting the check valve with the feed line and connecting the pressure relief valve with the return line.

17. The system of claim 16, wherein the fittings are barbed fittings constructed and arranged to engage tubing.

18. The system of claim 13, further comprising a second check valve within the second leg and constructed and arranged to permit fluid to flow in one direction from the engine to the reservoir and to prevent fluid to flow in a direction opposite the one direction.

* * * * *